United States Patent [19]

Davis, Jr.

[11] 3,946,244

[45] Mar. 23, 1976

[54] CHRISTMAS TREE LIGHTING CONTROL

[76] Inventor: George B. Davis, Jr., 7512 Marbury Road, Bethesda, Md. 20034

[22] Filed: Jan. 21, 1975

[21] Appl. No.: 542,803

Related U.S. Application Data

[63] Continuation-in-part of Ser. No. 418,262, Nov. 23, 1973.

[52] U.S. Cl. ..... 307/31; 315/185 S

[51] Int. Cl.[2] ..... H05B 37/00

[58] Field of Search ..... 307/11, 31, 35; 315/185 S, 315/192, 121, 123, 126, 127, 128; 323/96

[56] References Cited

UNITED STATES PATENTS 3,864,580 2/1975 Davis ..... 307/31

*Primary Examiner*—Herman J. Hohauser

[57] ABSTRACT

A Christmas tree lighting control wherein predetermined voltage changes and changes in the duty cycle of the A-C source is applied individually and in a predetermined sequential order to all the lights of a tree to produce a twinkling and shimmering effect heretofore unobtainable by any form or combination of conventional flasher apparatus.

11 Claims, 3 Drawing Figures

CHRISTMAS TREE LIGHTING CONTROL

This is a continuation in part of now pending application Ser. No. 418262, Group 217.

This invention relates generally to Christmas tree lighting and more particularly to a Christmas tree lighting control that when in operation, effects a continually changing light intensity output throughout all the lights of a tree and in a predetermined manner to produce a twinkling or shimmering of the lights rather than the conventional method of making and breaking the circuit through the lamps to produce a flashing or by so reducing the voltage thereto as to produce a similar flashing result.

With the increasing desire of the public for movement or action in Christmas tree lighting, the use of string flashers or individual flasher bulbs has become widely accepted. While such devices do relieve the lifelessness of a lighted tree, the violent action of flashing lights can become quite annoying particularly when such flashing affects the entire string. This is generally the case even when not looking directly at the tree. The on and off of any light source within a room, such as the flashing of tree lights, can become quite distracting. This is particularly true when the flashing of two or more strings reach a condition of synchronization so as to flash simultaneously. Such a condition will invariably occur when any flasher apparatus operates individually whether in bulbs or strings.

It is an object of the present invention to provide a new and improved Christmas tree lighting control which, when in operation, applies a plurality of continually changing power conditions to all the lights of a tree and in a predetermined order.

A further object is to provide a voltage control for Christmas tree lighting wherein the circuits to the lights are never interrupted to cause flashing, but is applied as a continually changing power factor to produce slight changes in light intensity and in such a manner as to effect a twinkling or shimmering of the lights of the entire tree.

A still further object is to provide a Christmas tree lighting control that will apply varying power conditions to a plurality of Christmas tree lighting strings simultaneously and in a manner to produce a coordination of lighting effects between the individual strings without materially varying the overall light intensity of the system.

A further object is to provide a control for Christmas tree lights preferably of the miniature series wired type and, if desired, may be used in combination with individually flashing bulbs.

In order that this invention may be more readily understood, reference is now made to the accompanying drawings wherein.

Figure 1:
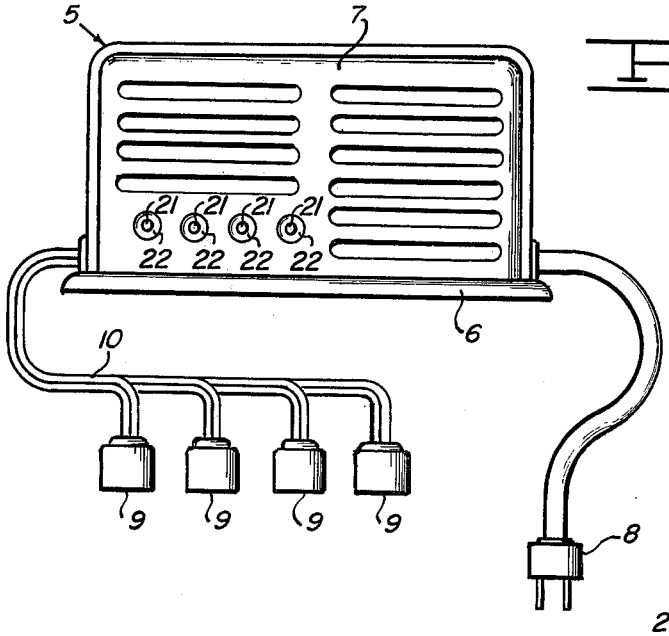
FIG. 1 is a side view in elevation of the assembled device of the invention as inclosed within the control housing.
Figure 3:
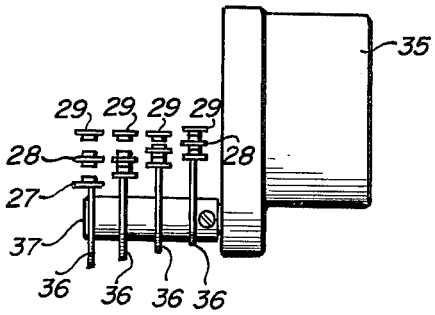
FIG. 3 is a view in elevation of the motor drive as it relates to the control operating cam portion of the device.

Referring now to the drawings, and more particularly to FIG. 1 thereof, wherein is shown the assembled device of the present invention and as will be generally designated 5 and to which may be connected strings of Christmas tree lights with the lights being of the series wired miniature type. The assembly 5 includes a mounting base 6 to which the perforated cover 7 is attached and wherein is enclosed the working mechanisms of the device. The connector 8 and power supply cord provides means for electrically connecting the device to a conventional 110 volt AC power supply source.

Extending from the end of the cover in the manner shown, is a number of electrical outlets 9 and into which, when in use, strings of Christmas tree lights are plugged. The lead wires 10 to the various outlets may be of any length desired, preferably, sufficiently long as to extend well into the tree for easy access to the lighting strings while allowing the control to rest beneath the tree or possibly some distance away.

Figure 2:
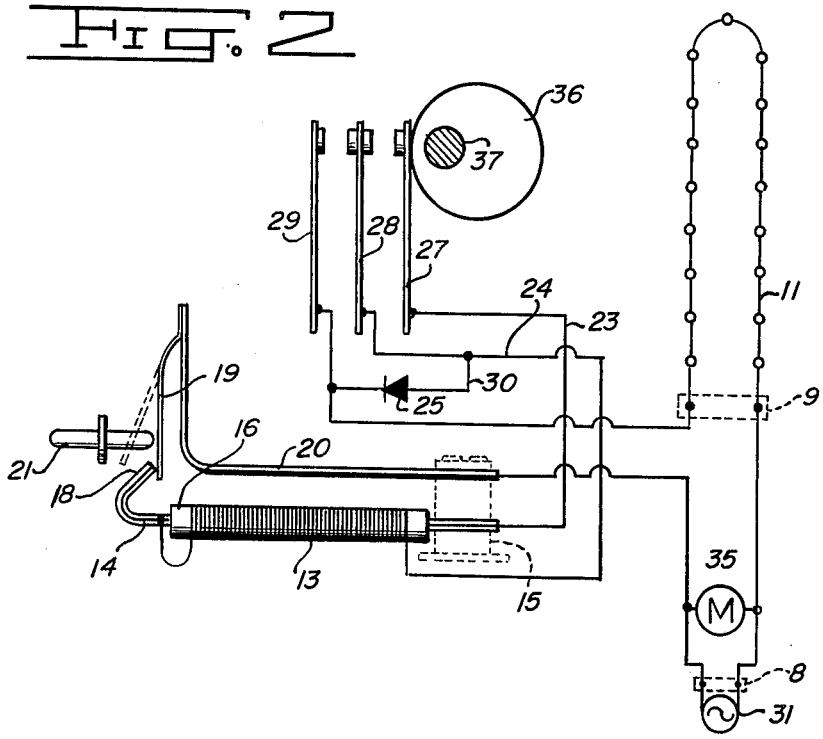
FIG. 2 is an electrical schematic of the device of the invention and as one of four such units contained within the housing shown in FIG. 1.

FIG. 2 shows the arrangement of the control units of the device that are mounted within the case 7 and their relationship electrically to the Christmas tree lighting string 11 to which it is connected by the outlet 9. The device includes a resistor element 13 which is preferably formed as a winding about a bemetallic strip 14 secured by branket 15 to the insulating base 6 of the device. Insulation 16 electrically isolates the resistors from the strip 14 except at point 17 whereupon the bare wire of the resistor is wound about the strip to make electrical connection therewith at the position shown.

Formed upon the free and of the strip 14 is a bent-down tang like member 18 so located as to extend over and maintain in a depressed position a spring contact finger 19 secured to the base 6 as by brackets 20 and 15. A plastic reset button 21 extends through the cover depression 22, FIG. 1, and against the contact finger 19 to depress the finger for electrical reset if released from the tang 18 by thermal movement of the strip 14, as will hereafter be more fully described.

Electrically connected by leads 23 and 24 across the resistor 13 are flexible contact members 27 and 28 which form part of the circuit controlling elements of the unit. The third flexible contact member 29 is electrically connected through a half wave rectifier or diode 26 to the contact member 28 by way of lead 30 in the manner shown.

In operation of the device thus far described, current is suppoied by was of the power source 31 to connector 8 thusly to put in operation a back-geared motor drive 35 having a shaft speed, desirably, of 20 revolutions per minute. The motor drives the cam 36 of the control by way of shaft 37. From the connector 8 circuit is likewise completed to the lamp string 11 by way of the outlet 9 after having passed through the bracket 20, the contact finger 19, the resistor 13 and diode 25. With both the resistor and diode 26 now in the lighting circuit, the lamps of the string are now at their lowest stage of brightness.

Spring contact member 27 which, by reason of the shown position of cam 36, is now in open circuit with respect to the spring contact member 28. As the cam is rotated, contact member 27 is forced by cam motion into electrical engagement with the contact member 28 to effect a shorting out of resistor 13 to cause a noticeable increase in brightness in the lamps by now applying therto a higher voltage relative to the voltage reducing value of resistor 13. Further rotation of the cam drives all of the contact members 27, 28, and 29 electrically together to short out both resistor and diode 25 to effect full brightness in the lamps by applying line voltage thereto by way of the bimetallic strip 14 and contact finger 19. Further rotation of the cam starts movement of the contact apart and with the separation of the three contact members 29, 28, and 27 the resistor and diode are again connected in the lighting circuit to complete one operation cycle of the device.

The configuration of the cam, as shown by the example 38, may be selectively varied between the four units of the control to produce a more random lighting effect throughout the lights of a tree. The operating interval between such light intensity changes should preferably be between 1 to 2 seconds, however, this may be varied selectively depending upon the design of the cam relative to the motor speed. The contacts member 27, 28, and 29 may be closed and opened in any sequence required to produce the desired effect. The cams of the four control units of the device are positioned with respect to each other preferably to prevent any light intensity changes between independently connected strings occuring simultaniously. This difference in the cams and their settings along with possible small variations in the resistors of the controls units will produce an overall shimmering and twinkling of the lights of a tree that is very pleasing and restful to observe and totally unobtainable by any form of independently operating device, such as, for example, a conventional flasher mechanism.

The device of the present invention is primarily designed for use with low current Christmas tree lights of the series wired miniature type and with resistor elements 12 being such as to produce the necessary voltage drop without overheating providing that only one or possibly two such miniature lighting strings are plugged into a single outlet of the device. However, if the electrical load upon the resistors is too great, as by plugging into one of the outlets of the device a greater number of strings then intended or attempting to connect therewith a large string of parallel wired lamps, the resistor elements will overheat to cause deflection of the bimetallic strip 14 from its contact with the finger 19 to free the latter allowing it to snap to its open circuit position with respect to the strip 14. Holding down the reset button 21 will not damage the mechanism which cannot be reset for operation until the overload upon the line has been eleviated.

While the design of the device, as herein shown, places the diode or half cycle device between the shorting contacts 28 and 29, it is understood that the positions of the diode and resistor 13 may be reversed with respect to these shorting contact members. It is further desired that during the operation of the device that the power factor to a lighting string connected with the device not be reduced to a valve that would cause the lamp luminous to deminish to what would appear to an observer as a flashing of the lamps.

While one version of the device is herein shown and described, it is understood that numerous variations and modifications may be resorted to without departing from the spirit and scope of the invention disclosed.

What I therefore claim and desire to cover by letters patent is:

1. A light intensity control for Christmas tree lighting including in combination connector means for connecting said control to a power supply source, a plurality of electrical outlets for receiving therein one or more strings of Christmas tree lights, a plurality of electrical circuits respectively connecting said outlets with said connector, voltage dropping resistor means, respectively connected in each of said connector circuits, rectifier means respectively connecting in each of said connector circuits, motor means, contact means movable by said motor means to intermittently short out, in predetermined sequence, said resistor means and said rectifier means to alter in predetermined increments voltage applied from said connector to said outlets.

2. A light intensity control as claimed in claim 1 wherein said contact means movable by said motor means is in the form of spring contact fingers connected respectively to the terminals of each of said resistor means and rectifier means and movable into and out of their respective shorting positions by rotation of cam means driven by said motor means.

3. A light intensity control as claimed in claim 1 wherein a circuit interrupting thermal overload is electrically interposed between the connector and each of said outlets.

4. A light intensity control for Christmas tree lighting including in combination connector means for connecting said control to a power supply source, a plurality of electrical outlets for connecting to said control one or more strings of Christmas tree lights, individual circuit means connecting said outlets with said connector means, voltage dropping resistor means connected within each said individual circuits to said outlets, half wave rectifier means connected in each of said individual circuits to said outlet and electrically connected in series with said resistor means, a motor drive, means movable by said motor drive to intermittently short out, in predetermined timed sequence, said resistor means and said rectifier means connected within said individual outlet circuits to vary in predetermined fixed increments and in timed spaced relation the power characteristics to said outlets.

5. A light intensity control as claimed in claim 4 wherein the means movable by said motor drive for sequentially shorting out the resistor means and rectifier means within said outlet circuits, is in the form of a rotating cam driven by said motor drive and operative to intermittently close contact members connected to the respective terminals of said resistor means and said half wave rectifier means.

6. A device as claimed in claim 4 wherein the voltage characteristics to said outlets is never decreased by greater than 80 percent of the supply voltage.

7. A light intensity control as claimed in claim 4 wherein a circuit interrupting thermal overload is electrically interposed between said connector and each of said outlets.

8. A light intensity control for Christmas tree lighting including in combination connector means for connecting said control to a power supply source, an electrical outlet electrically in circuit with said connector for connecting with the latter one or more strings of Christmas tree lights, voltage dropping resistor means connected in series between said connector and said outlet, half wave rectifier means connected in series with said resistor, a motor drive, cam means driven by said motor drive, contact members movable into and out of electrical engagement by movement of said cam means and connected to intermittently short out said resistor means, contact members movable into and out of electrical engagement by movement of said cam means and connected to intermittently short out said half wave rectifier means with the resistor and rectifier shorting operations occuring in predetermined sequential order to alter in predetermined fixed increments the light intensity output of a lighting string connected to said outlet.

9. A light intensity control as claimed in claim 8 wherein the operation of said cam means, effecting the intermittent shorting out of said resistor means and rectifier means, occurs in predetermined time differing relation with respect to the intermittent shorting out of said resistor means.

10. A light intensity control as claimed in claim 8 wherein a thermal overload connected in series with said resitor and operative upon a predetermined heating of said resistor to interrupt the circuit through said resistor.

11. A light intensity control as claimed in claim 8 wherein the power output of said control is never reduced to a value that could reduce the light intensity output of a lighting string connected therewith to less than 80 percent of full brightness.

* * * * *